United States Patent [19]

Funderburk

[11] Patent Number: 4,974,347

[45] Date of Patent: Dec. 4, 1990

[54] BASEBALL SHOE SOLE

[76] Inventor: Leonard G. Funderburk, P.O. Box 9216, So. Lake Tahoe, Calif. 95731

[21] Appl. No.: 217,871

[22] Filed: Jul. 11, 1988

[51] Int. Cl.[5] ..... A43B 5/00

[52] U.S. Cl. ..... 36/126; 36/114

[58] Field of Search ..... 36/126, 134, 67 A, 67 D, 36/59 C, 25; 273/25

[56] References Cited

U.S. PATENT DOCUMENTS

| | | | |
|---|---|---|---|
| 2,006,637 | 7/1935 | Goldenberg | 36/134 X |
| 3,100,354 | 8/1963 | Lombard et al. | 36/25 R |
| 3,316,662 | 5/1967 | Schmadeke | 36/59 C |
| 4,315,374 | 2/1982 | Sneeringer | 36/126 |
| 4,527,344 | 7/1985 | Mozena | 36/126 |
| 4,574,498 | 3/1986 | Norton et al. | 36/126 X |
| 4,590,693 | 5/1986 | Kawashima et al. | 36/126 |
| 4,667,425 | 5/1987 | Effler et al. | 36/126 |

*Primary Examiner*—Paul T. Sewell
*Assistant Examiner*—Andrew D. Meyers

[57] ABSTRACT

A general purpose baseball shoe sole with significant advantages for a baseball pitcher, whether he be in Little League or the professional ranks. The sole can be molded from a resilient material with tread members creating a longitudinal vallecular area or cleatless with an unobstructed channel in the sole. The longitudinal channel or vallecular area promote the unique anchoring characteristic of the sole. A means for the pitcher to obtain a stable foothold atop the pitching rubber, enabling him to thrust against the top front of the pitching rubber with his foot while pitching towards home plate. When utilizing the disclosure properly the pitcher can be relieved of endeavoring to furrow a hole in the dirt to the front of the pitching rubber in which to set his foot, and then bracing his foot against the pitching rubber. Instead, the top front edge of the pitching rubber fits into the groove in the sole of the shoe. When used in conjunction with the pitching rubber the pitcher will experience a greater degree of accuracy, leverage, consistency, angle height, ease and uniformity of the pitch. Much of the stress that occurs in the arm and ankle of the Little Leaguer when using the regulation pitching rubber can be alleviated by wearing this shoe.

1 Claim, 2 Drawing Sheets

BASEBALL SHOE SOLE

BACKGROUND OF THE INVENTION

1. Field of the Invention

The present invention relates to baseball shoe soles, and more particularly, to a multi-purpose sole which is especially designed for use as the outer sole of a baseball pitcher's shoe.

2. Description of Related Art

Baseball cleats now come in a wide variety of designs, primarily designed to give traction advantages on artificial or natural surfaces, exemplified by U.S. Pat. No. 4,315,374, of Andrew M. Sneeringer, issued Feb. 16, 1982.

Baseball pitchers thirteen years of age and older still position themselves on the pitching mound as they did 50 years ago. They dig a hole in front of the pitching rubber, incline the inside of their foot towards home plate and pitch the ball. Thereby subjecting themselves to the conditions of the weather and consistency of the dirt which the cleats thrust against for traction. There is also a considerable loss of elevation in relationship to home plate; resulting in undue exertion of the pitcher, since it is easier to throw down hill than horizontally.

A further task of the pitcher is the perennial difficulty of obtaining a good pitching motion and then duplicating that motion once achieved. All things being equal, a more consistent placement of the foot windup and delivery could be accomplished on a regular basis as opposed to the use of an inconsistent hole dug by an opposing pitcher's likes or dislikes.

Little League Baseball players are 12 years of age and under, and are confronted with another problem. The pitching rubber in Little League was redesigned due to the numerous negatives associated with digging a hole in front of the pitching rubber and the rules requiring the pitcher's foot to stay in contact with the pitching rubber while pitching. But, since altering the pitching rubber the pitcher has been forced to change his pitching motion to a more unnatural thrust from the backside of the foot and ankle. Since the player must place his foot directly on the flat rubber during the pitch he is also dealing with the potentially slippery surface of the top of the pitching rubber.

Up until this time, the matter of pitching difficulties has not been addressed or resolved.

This invention is not just an improvement of a previously disclosed baseball shoe. It is a unique advancement in baseball equipment.

In examining the prior art I find no baseball shoe sole resembling my present invention or a baseball shoe designed for the purpose of aiding a pitcher.

OBJECTS AND SUMMARY OF INVENTION

It is the primary object of the present invention to provide a superior cleat design giving a baseball pitcher greater control over his abilities than available before.

Another object is to permit the pitcher to pitch from the top front of the pitching rubber, which allows him to pitch from the highest point on the mound which increases his force or "angle of attack", since it takes less effort to pitch downhill, and enables him to take further advantage of the laws of gravity and his own body weight which would lessen the physical strain on his arm. Also by being able to position your thrust foot on the pitching rubber you have the advantage of locking your foot at the same angle in relation to home plate every time.

The pitching rubber itself is not as affected by different playing conditions such as rain, mud, drought, etc., than a hole dug in the dirt; which will give a major advantage in obtaining a consistent pitch.

Given the capability to thrust from a rigid pitching rubber with less give and slippage, the pitcher will have more snap in his throw, helping him to increase his efficiency.

It is also the object of the invention (for children twelve and under) to change the point of thrust from FIG. 5 as shown in my drawings, which puts unnatural pressure on the backside of the foot and ankle, to a more natural position as illustrated on FIG. 6, which puts the thrust pressure under the bottom of the foot.

A further advantage is that the baseball shoe will have an extended life, because it will not be subjected to the abrasive thrusting and dragging in the dirt that is now occuring on the pitching mound.

The following description is of the Preferred Embodiment which is a multi-purpose baseball shoe that is well suited for all ages and can be used by any player in the field including the pitcher.

A softball player or pitcher can also utilize this type of shoe sole by converting the thrust line of the Preferred Embodiment to one that could be used on a softball pitching mound.

Various advantages and features of novelty which characterize the invention are pointed out with particularity in the claims attached hereto and forming a part of the present disclosure. However, for a better understanding of the invention, its advantages and objects obtained by its use, reference should be given to the drawings which form a further part hereof and to the accompanying descriptive manner in which there is illustrated and described several embodiments of the invention.

All drawings are of the right shoe only.

DRAWING REFERENCE NUMBERS

Figure 2:
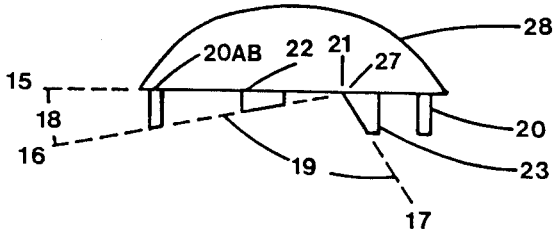
FIG. 2 is a cross section frontal view of FIG. 1.

14 view of FIG. 2

15 reference line parallel to bottom surface of shoe sole 24

16 angle line showing diminishing height of cleats as they get nearer to 21 in the Preferred Embodiment

17 reference line showing angle on face of inclined wall thrust member 23 in the Preferred Embodiment

18 area containing cleats between lines 15 and 16

19 vallecular area between lines 16 and 17

20 tall perimeter tread members located toward the left side of the wearer's shoe sole adjacent to edge 2O*a* perimeter tread members located towards the right side of the wearer's shoe sole adjacent to edge and dedicated to 16

2O*ab* tall perimeter tread member with a slightly angled bottom which is no taller than 16

21 a designated thrust line on the sole showing bottom of vallecular area in a baseball shoe

21*a* designated thrust line on the sole showing bottom of vallecular area in a softball shoe sole

22 general purpose tread member dedicated to 16

23 tall inclined wall thrust member with rectangular base

23*a* tall perimeter cleat with one inclined wall dedicated to row of thrust members 23

24 lower major surface

25 Little League baseball pitching rubber

26 thrust direction while throwing baseball

27 convergence of lines 15, 16 and 17 creating dedicated thrust angle and bottom of vallecular area

28 shoe upper

DETAILED DESCRIPTION OF THE PREFERRED EMBODIMENT

Figure 1:
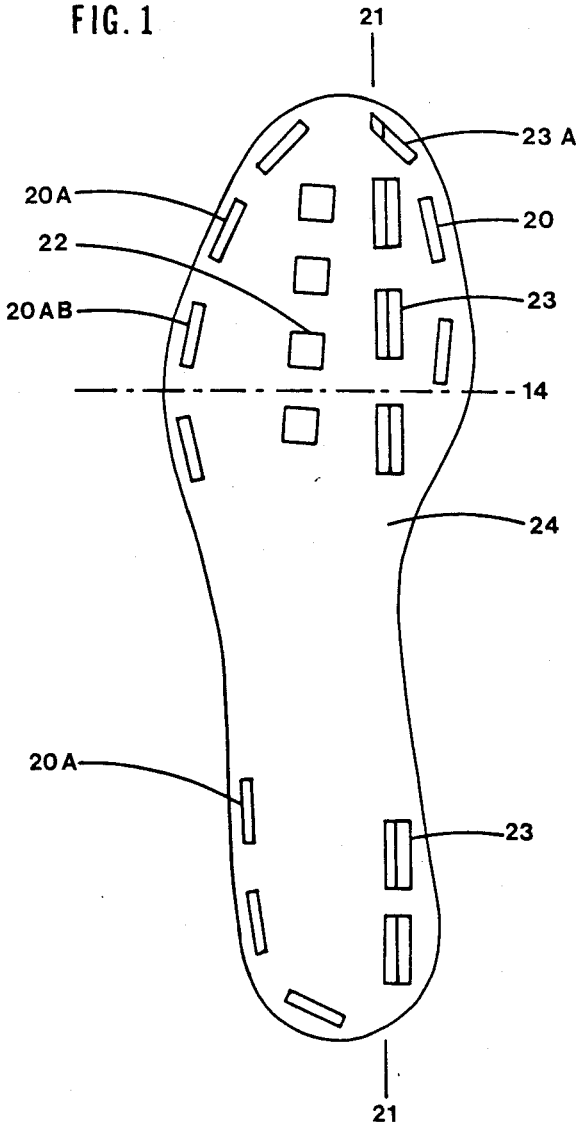
FIG. 1 is a full bottom view of the Preferred Embodiment right shoe sole.

Referring to the drawings in detail wherein like numerals indicate like elements, there is shown in FIG. 1 the Preferred Embodiment of the cleated baseball shoe sole. The baseball or softball shoe includes an essentially conventional shoe upper made of leather, cloth or other plyable material, which is joined to a sole assembly including a cleated outer sole by glue, sewing, rivets, present or future current art methods, or other conventional means. The cleated outer sole comprises a relatively hard rubber or other moldable, resilient, polymeric material, leather, metal or a combination of durable materials, which are highly resistant to wear and abusive treatment.

The sole includes a base 24 having a major exterior surface from which a plurality of cleats of different types extend.

With particular reference to FIG. 1, various preferred detailed features of the cleats will now be described. It will be appreciated from this planal view that the various tread members are shown as integrally molded (rivets or other means may be employed if metal cleats are used) with base 24. Cleats 20, 2O*a*, 2O*ab* and 23*a* are the perimeter tread members disposed adjacent to the outside edge of the sole.

Details of cleat 20 are as follows: one of the taller perimeter tread members located on the inner side of the sole, having a mostly flat bottom surface, in usually an upright perpendicular relationship to the sole. Side walls of this tread member are not necessarily angles. Material of tread members may be comprised of a metal or other highly resilient polymeric substance to provide the utmost in durability and traction depending on type of surface played on, such as dirt, grass or astroturf.

This cleat gives a laterally stabilizing effect during a side ways motion of the foot. The tread member is rather wide and shallow and can be as tall as the baseball rules would allow.

Cleat 2O*a* is one of the relatively large perimeter tread members adjacent to the outside edge of sole, dedicated to angle 16 in height. This cleat is similar in shape to 20, having a usually upright perpendicular relationship to the sole. Material of tread member may be comprised of a metal or other highly resilient polymeric substance to provide the utmost in durability and traction.

Details of 2O*ab* are outlined in the following description. One of the perimeter tread members adjacent to the out side edge of the sole. This cleat gives a laterally stabilizing effect during a sideways movement of the foot, and can be as tall as the tallest cleat on the sole.

Figure 3:
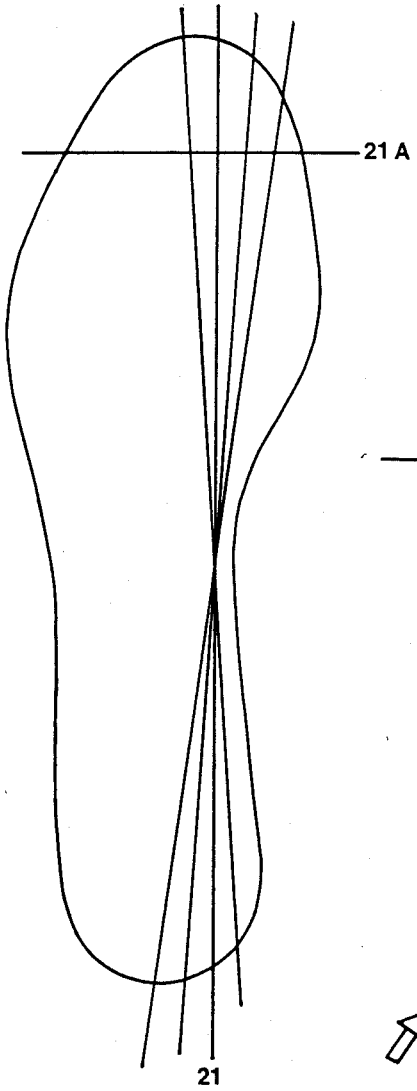
FIG. 3 is a full bottom view of shoe sole showing a multitude of possible designated thrust line placements .
Figure 4:
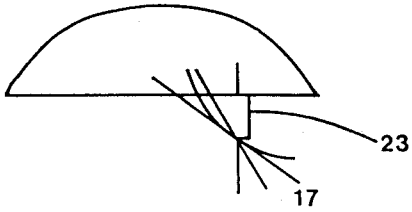
FIG. 4 is a cross section of FIG. 3, showing a varied number of possible angles on the inside of the inclined wall thrust members.

With continuing attention to the drawing; the tall inclined wall thrust member 23 will now be described. Cleats 23 comprise a heavy solid lug cleat disposed along the sole on a straight designated thrust line 21, FIG. 3. These are strong cleats preferably made of a conventional, hard, resilient and wear resistant material such as rubber or a comparable synthetic material or metal. These inclined wall thrust members 23 can be as tall as the tall 20 cleats. The extreme bottom of this member 23 is rather narrow and flat. In FIG. 4 the principal side of this described member, closer to the center of the sole has an inclined side that would make contact with the front edge of the pitching rubber. FIG. 3 shows many possible straight designated thrust lines (21 to 21*a*) for custom fitted baseball or softball shoes. Both ends of 23 may be quadrangles.

In reference to 23*a;* a modified form of 23. The sloping side of this member is proximate to the same angle and is contiguous to line 21 in FIG. 3, as are the aforementioned inclined wall thrusting members 23. One of the longest perimeter tread members as tall as cleats 20, except where contiguous to the inclined wall thrust members 23. A rather broad cleat positioned near the toe of the shoe sole 24, aiding in forward and backward movement.

The cleat can be manufactured from a variety of synthetic materials as mentioned above, including metal or a combination of metal and a hard plastizoid material.

Attention will now be directed to tread member 22. A group of general purpose cleats. They can be a variety of forms, dimensions and arrangements as to occupy any void area of the sole 24, where general purpose traction and support is needed. The bottom contact surface of 22 must not protrude beyond the angle line 16 in FIG. 2. The nearer these tread members 22 are to the inclined wall thrust members 23 the shorter in height they will be. All of the 22 cleats must be contained within the height limitations of angle 18 in FIG. 2.

The following is a description of the Preferred Embodiment drawn in FIG. 2. This is a cross section of a shoe for the right foot as shown in FIG. 1, viewing from the front area.

FIG. 2 clearly shows the recess that is obtained by shortening in height and angling the size and shape of the downward cleats and the angle created by the lessening of vertical dimension beginning with cleats 2O*ab* and continuing with cleats 20*a* and 22. The angle line 16 continues diminishing in height until reaching point 27; the intersection of angle lines 15, 16 and 17. Tread members 2O*a*, 2O*ab* and 22 must be contained within area 18 so as not to obstruct the open vallecular area of 19. The vallecular area 19 created does not have to be parallel to sole surface 24 from heel to toe if needed for a custom fitted shoe.

DETAILED DESCRIPTION OF THE INVENTION

Figure 5:
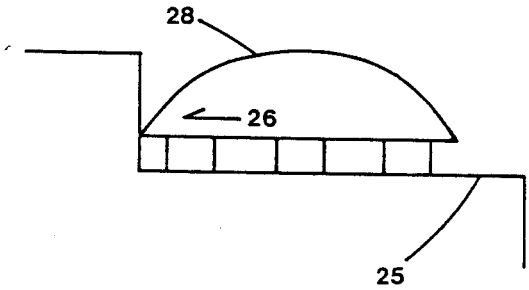
FIG. 5 is a frontal cross section of a commonly cleated baseball shoe flat on the Little League pitching rubber.

FIG. 5 represents a cross section of a standard multipurpose baseball shoe presently used in Little League; in conjunction with a Little League pitching rubber 25. Arrow 26 shows the direction of thrust momentum while pushing from the pitching rubber 25. FIG. 5 also shows the two step design of the required regulation pitching rubber 25 utilized in Little League baseball today.

The cleat design of the shoe in FIG. 5 illustrates the style of the shoes now being worn in Little League and the necessary position of the foot during the pitching motion. The thrust is originating unnaturally from the outside of the foot and ankle. This action possibly contributes to undue stress and pronation of the ankle and knee.

Figure 6:
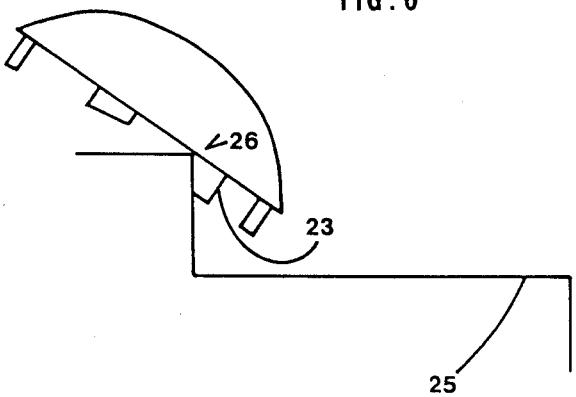
FIG. 6 is a cross section frontal view of the Preferred Embodiment with inclined wall thrust members in contact with the Little League pitching rubber.

Referring now to FIG. 6, there is shown the improved sole of the disclosure. This is a cross sectional view of the right shoe of the invention atop the pitching rubber. The sole depicted is similar to the Preferred Embodiment in FIG. 2, representing my multi-purpose baseball player's shoe. The shoe in FIG. 6 shows the placement of the cleats during the wind-up at a point where the pitcher is getting ready to thrust toward the catcher with cleats against the regulation Little League baseball pitching rubber 25; illustrating the more natural thrust from the bottom of the foot. Even though the pitching rubber for boys 13 years old and older is not a two step design, the present invention would work similarly on their style of pitching rubber. Materials used in the cleats illustrated should be a durable, synthetic or natural rubber-like substance, meeting the requirements for Little League.

In FIG. 3 the adaptability of the longitudinal horizontal alignment 21 through 21*a* is illustrated. Ref. 21 through 21*a* represents a variety of attitudes that may be utilized for placement of the inclined wall thrust members 26 in a baseball or softball player's shoe sole. Even though several angles of the designated base line 21 through 21*a* have been drawn the player is not limited to these. It is possible to produce a sole with a customized designated thrust line 21 through 21*a* for an individual player's specifications.

FIG. 4 shows a cross section of a baseball shoe with a tread member shaped similarly to inclined wall thrust member 23. Not only may the thrust line 21 through 21*a* be custom ordered, but the degree inclination 17 of the inclined wall thrust members may also be custom ordered. In FIG. 4 the angle of thrust members 23 and 23*a* are not confined to the Preferred Embodiment. Ref. 17 gives examples of a few different angles relating to the face of inclined wall thrust members 23 that may be made to individual preferences.

FIG. 3, line 21*a* shows an embodiment designed with a softball pitcher's needs in mind. The designated line would be disposed in a crosswise manner near the ball of the foot and could be even closer to the toe of the shoe. This would accommodate pitching according to softball rules necessitating a forward placement of the foot during the pitching motion.

The left foot sole design would be a mirror image of the drawing figures.

The accompanying drawings are approximate in size and should not be considered to scale.

OPERATION OF THE INVENTION

The baseball sole in FIG. 1 has outside perimeter cleats (20, 2O*a*, 2O*ab* and 23*a*), making this a good multi-purpose baseball shoe sole with the added advantage of an extra row of cleats 23 for improved traction for any player at any position when making a side thrust move whether for throwing or striding to hit a baseball.

When a pitcher uses the shoe in FIG. 1 from the top front of the pitching rubber he starts his windup by having his feet pointed towards home plate, perpendicular to the pitching rubber. He then turns or slides his thrust foot about 90° to parallel the front of the pitching rubber, allowing his foot to slightly slant on the inner side, letting the full length cleats 20, 23 and 23*a* drop over the front edge of the pitching rubber 25, which makes it possible for the foot to be securely planted on the top front of the pitching rubber 25 with the diminishing height cleats 2O*a*, 2O*ab* and 22 (along angle 16) supporting the pitcher's body weight, while locking at point 27 (where lines 15, 16, 17 and 21 intersect) on the top front edge of the pitching rubber.

The pitcher continues his pitching motion allowing his thrust foot to roll towards home plate permitting the inclined wall thrust members 23 (FIG. 2 angle line 17) to come into contact with the front edge of the pitching rubber 25, FIG. 6, enabling the pitcher to complete his thrust towards home plate from a consistent, secure, higher and more vantaged position.

In softball the pitcher would start and end his windup with his foot perpendicular to the pitching rubber.

While my above description contains many specificities, these should not be construed as limitations on the scope of the invention, but rather as an exemplification of the Preferred Embodiment thereof. Many other variations are possible. For example: the cleats can be made from a plastic or metal material or a combination of the two. The cleats may be permanently attached to the sole or may be the replaceable type. The shoe soles could have more traction or comfort if the shoes were augmented with more or less traction elements dispersed on the soles depending upon the type of playing surface. As will be noted the preferred sole design contains a vallecular area formed by the cleats, but it is possible to create a usuable shoe sole with no vallecular area by merely having some gripping elements to make contact with the edge of the pitching rubber while having other shorter traction elements located to fill in the open areas of the sole.

Numerous characteristics and advantages of the invention have been set forth in the foregoing description and operation statement, together with details of the structure and function of the invention, and novel features thereof are pointed out in the appended claim. The disclosure, however, is illustrative only, and changes may be made in detail, especially in matters of shape, size and arrangement of parts, within the principal of the invention, to the full extent indicated by the broad general meaning of the terms in which the appended claim is expressed.

I claim:

1. I claim as my invention:

A baseball or softball shoe sole formed of durable materials having a heel section, an arch section, a forefoot section and a lower major surface comprising:

a plurality of tread members extending downwardly from said lower major surface of said base including a plurality of partial heel and forefoot tread members located at spaced intervals adjacent to the outside edge of the sole's perimeter in the heel and forefoot sections respectfully;

a plurality of general purpose tread members located inside the boundary of the perimeter tread members;

a row of tall inclined wall thrust members disposed along a straight designated thrust line on the sole;

said perimeter tread members disposed along the outer side of the said general purpose tread members increasing in height as the distance increases farther from the base of the inclined wall thrust members;

and said perimeter tread members diminishing in height as the distance to the designated thrust line decreases, defining an unobstructed vallecular area.

* * * * *